United States Patent [19]

Hasegawa

[11] 4,448,555

[45] May 15, 1984

[54] IMPACT PRINTING APPARATUS WITH INTERCHANGEABLE ROTARY TYPE WHEELS

[75] Inventor: Keiji Hasegawa, Tokyo, Japan

[73] Assignee: Ricoh Company, Ltd., Tokyo, Japan

[21] Appl. No.: 358,556

[22] Filed: Mar. 16, 1982

[30] Foreign Application Priority Data

| | | | |
|---|---|---|---|
| Mar. 20, 1981 | [JP] | Japan | 56-40570 |
| Mar. 20, 1981 | [JP] | Japan | 56-40571 |
| May 27, 1981 | [JP] | Japan | 56-80383 |

[51] Int. Cl.[3] ..... B41J 1/30

[52] U.S. Cl. ..... 400/144.2; 400/171; 400/175; 101/93.19

[58] Field of Search ..... 400/144.2, 144.3, 171, 400/174, 175; 101/93.17, 93.19

[56] References Cited

U.S. PATENT DOCUMENTS

| | | | |
|---|---|---|---|
| 3,892,303 | 7/1975 | Willcox | 400/171 |
| 4,026,403 | 5/1977 | Inose et al. | 400/144.2 X |
| 4,126,400 | 11/1978 | Suzuki et al. | 400/144.3 X |
| 4,209,262 | 6/1980 | Savage | 400/144.2 |
| 4,281,938 | 8/1981 | Phillips | 400/171 |

*Primary Examiner*—Clifford D. Crowder
*Attorney, Agent, or Firm*—David G. Alexander

[57] ABSTRACT

An impact printing apparatus automatically discriminates the kind of a type element mounted on a reciprocating carriage of the printer and interchangeable with another type element. A print control program is selected in conformity to the specific kind of type element while desired printing is carried out according to the selected program. Each of the interchangeable type elements is provided with a mark or marks or coded data to be detected by a sensor which is located in a predetermined position on a stationary part of the printer. The mark or coded data is sensed while the type element is rotated or while the carriage carrying the type element is moved. A single mark in the form of a slit is formed in a rotary hub of the type element, and the sensor for detecting the mark comprises a light emitting element mounted on the carriage and a light receiving element mounted on the stationary part of the printer which corresponds to the light emitting element. A plurality of marks in the form of magnetic pieces are arranged on the rotary hub, tongue or mark bracket of the type element, and the sensor comprises a magnetic sensor mounted on the stationary part of the printer.

26 Claims, 13 Drawing Figures

IMPACT PRINTING APPARATUS WITH INTERCHANGEABLE ROTARY TYPE WHEELS

BACKGROUND OF THE INVENTION

The present invention relates to an impact printing apparatus which employs a set of interchangeable type elements to print out a desired kind of alphanumeric characters and the like in conformity to the kind of expected input data. More particularly, the present invention is concerned with an impact printer which can identify each specific type element mounted thereon to optimumly match various printing conditions to the identified type element.

A serial impact printer is known of the type which is furnished with a set of interchangeable type elements to be operable with any one of the type elements which matches with a kind of expected input data as regards the alphanumeric characters and the like carried thereon. In this type of serial printer, the printing pressure and pitch should preferably be controlled in an optimum manner for the size and style of types and the kind of other symbols which are carried on each type element. Also, the serial printer has to perform a type selection control for selecting types on a type element in response to input data in accordance with type codes prescribed by ASCII or JIS. Thus, the printer stores control programs each corresponding to a specific type element while each type element is provided with a coded mark for discrimination. When loaded in the printer, a type wheel is distinguished from the others through its own coded mark and a control program matching with the kind of the specific type element is selected.

A prior art impact printer having such an additional function includes a type element in the form of a wheel which is provided with a mark constituted by a magnetic piece (or a plurality of coded marks) in a suitable location thereof, and a magnetic sensor for magnetically sensing the mark or marks. These component parts are mounted on a carriage together with a type selecting motor, the type element being detachably mounted on the output shaft of the motor. The carriage is movable horizontally along a platen which is in turn movable to feed a sheet of paper vertically in a stepwise manner. While the type element is rotated from its home position or reference position for a type selection control, the magnetic sensor detects the mark so that the kind of the type element is automatically discriminated based on the angular distance from the home position to the mark (or reading the coded data).

In this prior art serial printer, however, the output of the sensor must be fed from the moving carriage over to a stationary part of the printer by a special flexible cable. The carriage carries thereon an electromagnet for driving a hammer and other drive lines as well as the motor for driving the type element, all of which are naturally wired to a power supply individually. Therefore, wiring the moving carriage to the stationary part of the printer increases the total number of wirings, which should preferably be as small as possible from the structural viewpoint. For this reason, the sensor signal line is frequently laid adjacent to the various power source lines. The output voltage of the magnetic sensor is as low as about several to several tens of millivolts and, therefore, it is fed to a control system in the stationary part of the printer via a carriage cable after being converted into a several volt, several milliampere signal by an amplifier. With such a jammed cable arrangement, the sensor output tends to involve inductive noise affected by the pulsing drive signals of several amperes which flow through the adjacent power source lines, resulting an error in the identification of the type wheel.

The carriage repeats sharp acceleration, stop and return throughout its printing operation. Where the sensor is mounted on such a carriage, a specially designed mounting means is indispensable to ensure a sufficient accuracy in relative position between the sensor and the mark on the type element. The amplifier for amplifying the sensor output and a power supply for the exclusive use of the amplifier must be mounted on the carriage which undergoes considerable vibration. Furthermore, the increase in the number of elements mounted on the carriage is contradictory to a general demand for a compact construction and, therefore, quite disadvantageous in the aspect of control, assembly and maintenance.

SUMMARY OF THE INVENTION

In accordance with the present invention, an impact printing apparatus automatically discriminates the kind of a type element mounted on a reciprocating carriage of the printer and interchangeable with another type element. A print control program is selected in conformity to the specific kind of type element while desired printing is carried out according to the selected program. Each of the interchangeable type elements is provided with a mark or marks or coded data to be detected by a sensor which is located in a predetermined position on a stationary part of the printer. The mark or coded data is sensed while the type element is rotated or while the carriage carrying the type element is moved. A single mark in the form of a slit is formed in a rotary hub of the type element, and the sensor for detecting the mark comprises a light emitting element mounted on the carriage and a light receiving element mounted on the stationary part of the printer which corresponds to the light emitting element. A plurality of marks in the form of magnetic pieces are arranged on the rotary hub, tongue or mark bracket of the type element, and the sensor comprises a magnetic sensor mounted on the stationary part of the printer.

A primary object of the present invention is to provide an impact printer which can distinguish a set of interchangeable type elements from each other in a sure and efficient manner.

It is another object of the present invention to provide a generally improved impact printer.

Other objects, together with the foregoing, are attained in the embodiments described in the following description and illustrated in the accompanying drawings.

DESCRIPTION OF THE PREFERRED EMBODIMENTS

While the impact printing apparatus of the present invention is susceptible of numerous physical embodiments, depending upon the environment and requirements of use, substantial numbers of the herein shown and described embodiments have been made, tested and used, and all have performed in an eminently satisfactory manner.

Figure 1:
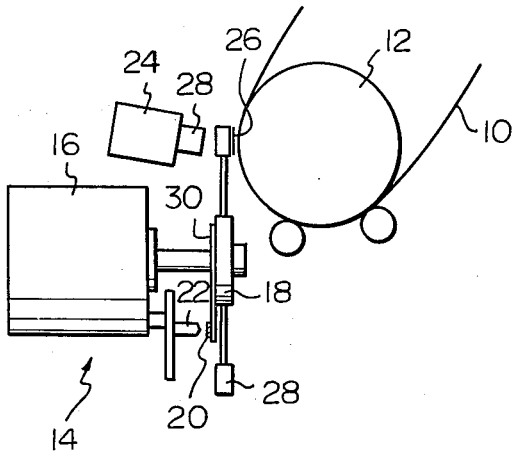
Fig. 1 PRIOR ART
FIG. 1 is a side elevation showing a prior art impact printer.
Figure 2:
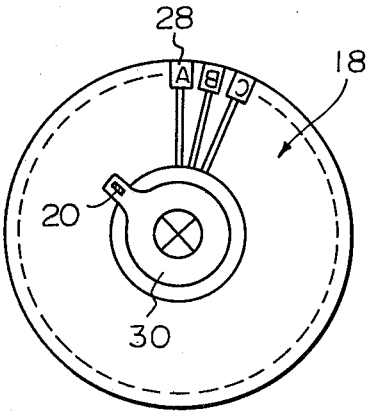
Fig. 2 PRIOR ART
FIG. 2 is a front view of a type element applicable to the printer of FIG. 1.
Figure 3:
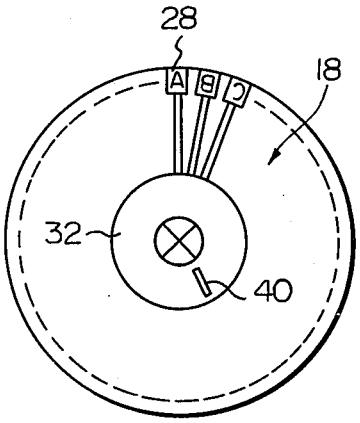
FIG. 3 is a front view of a type element applicable to the present invention.

Referring to FIGS. 1 and 2 of the drawings, there is shown a prior art serial impact printer which is capable of identifying each interchangeable type element. A carriage 14 is movable horizontally along a platen 12 which is adapted to feed a sheet of paper 10 vertically step by step. The carriage 14 carries thereon a type selecting motor 16 which in turn detachably carries a type element or wheel 18 on its output shaft. A mark 20 in the form of a magnetic piece is disposed on the type wheel 18 at a suitable location for detection, while a magnetic sensor 22 for sensing the mark 20 is mounted on the carriage 14. During rotation of the type wheel 18, the sensor 22 senses the mark 20 so that the kind of the type wheel 18 is identified automatically in terms of the specific angular distance from the home position to the mark. Also mounted on the carriage are a hammer 24 and a type ribbon 26. The type wheel 18 has type members 28 at the radially outermost ends of its fingers or tongues and a mark bracket 30 associated therewith.

As previously discussed, such a printer having the sensor on the movable carriage has involved various drawbacks in the control, assembly and maintenance such as that the cable leading from the sensor is located too close to the other cables to prevent interferance, that a special means is needed to accurately position the sensor relative to a mark on a type element, and that the carriage has to be loaded with a larger number of parts.

Reference will be made to FIGS. 3–13 for describing various embodiments of the present invention which eliminate all the drawbacks stated above. In these drawings, the parts and elements common to those shown in FIGS. 1 and 2 are designated by the same reference numerals.

Figure 4:
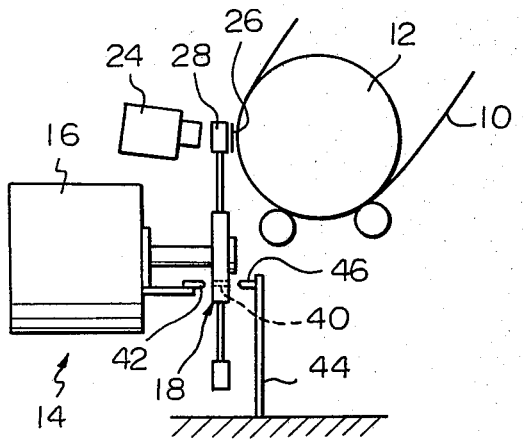
FIG. 4 is a side elevation of an impact printer embodying the present invention and with the type element of FIG. 3 mounted thereon.

Referring to FIGS. 3–6, a type element 18 in the form of a wheel has a rotary hub 32 which is formed with a slit 40 at its suitable circumferential location. As shown in FIG. 4, a photosensor comprises a light emitting diode or like light emitting element 42 and a phototransistor or like light receiving element 46 which are mounted on a movable carriage 14 and a stationary frame member 44 of the printer, respectively. The light emitting and light receiving elements 42, 46 are located on the opposite sides of the type wheel 18 in correspondence with the slit 40. When the type wheel 18 is rotated, the slit 40 can be detected by the photosensor 42, 46.

The printer is furnished with a set of interchangeable type wheels 18 each of which is formed with a slit 40 in a specific circumferential position of the rotary hub 32 different from the others. Initially, the carriage 14 is held stationary in a predetermined position where the light emitting element 42 thereon faces the light receiving element 46 on the frame member 44, e.g. home position. Then, the light emitting element 42 is energized and the type wheel 18 is driven for rotation from the home position, whereby the slit 40 is optically detected by the light receiving element 46. With this construction and operation, the type element 18 can be automatically identified in terms of the angular distance from the home position to the position where the slit 40 is detected.

If desired, the type wheel 18 may be formed with a reference slit in its home position in addition to the slit 40. Furthermore, the rotary hub 32 of the type element 18 may be formed with a plurality of coded slits suitably along the circumference so that they can be successively read by the light receiving element 46. The light receiving element 46, naturally, may be of the type which responds to interception of light by the webs between adjacent slits, instead of passage of light through the slits.

To locate the type wheel 18 at its home position on the carriage, the rotary hub 32 may be formed with a slit at a reference position as mentioned so that the photosensor 42, 46 can sense the slit. This, however, cannot locate the type wheel 18 to the home position unless the carriage 14 has been brought to a stop in a preselected position corresponding to the light receiving element 46 on the frame member 44. Alternatively, where the type selecting motor 16 comprises a servo motor, a rotary encoder mounted on the motor may be preset with a reference position such that the type element 18 keyed or otherwise secured to the output shaft of the motor to a predetermined relation has its home position determined by an angular position of the motor. This is advantageous over the first-mentioned locating implement in that the type wheel 18 can be located to the home position even during travel of the carriage 14 to facilitate quick identification of the type wheel 18.

Figure 5:
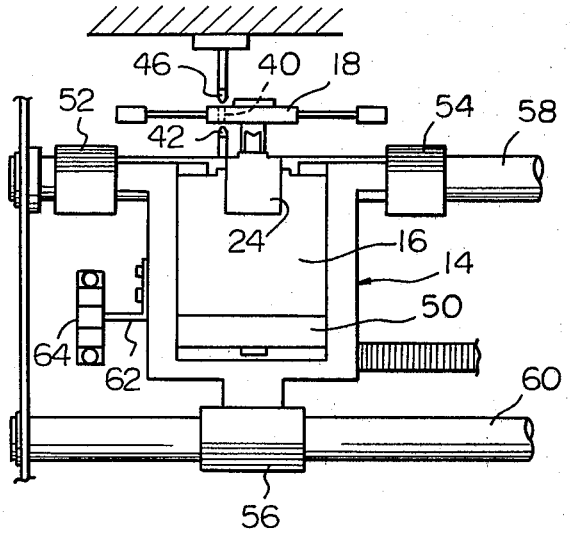
FIG. 5 is a plan view showing details of a carriage section of FIG. 4 which is in its home position.

Referring to FIG. 5, an example of the carriage 14 and its associated parts are illustrated with the carriage 14 in the home position. The carriage 14 is loaded with the type wheel 18, the type selecting motor 16, a rotary encoder 50, the hammer 24 etc. The carriage 14 is mounted laterally movable on a pair of guide rods 58, 60 through bearings 52, 54, 56. A motor (not shown) is in driving connection with the carriage 14 through a cable which is passed over pulleys or the like. A photointerrupter 62 is mounted on one end of the carriage 14 while a photosensor 64 is secured to a frame member of the printer to cooperate with the photointerrupter 62 for sensing the leftmost position of the carriage 14 as viewed in FIG. 5. Under the control of a controller (not shown), at least the start and stop of the reciprocation of the carriage 14 and those of the rotation of the type element 18 are performed as desired.

In operation, the operator fixes a desired type element 18 to the carriage 14 and then supplies the controller with an initial set command or a power supply on command as by depressing a push-button. In response to the command, the controller moves the carriage 14 leftwardly to a position where the photointerrupter 62 is detected by the photosensor 64 and, thereafter, rightwardly a predetermined distance away from said position. This locates the carriage 14 in a predetermined home position. Next, the controller turns on the light emitting element 42 and drives the motor 16 to rotate the type element 18 at the same time. The controller first detects a pulse signal indicative of the home position of the type element 18 which is coupled thereto from the rotary encoder 50, thereupon starting counting the encoder clock. When the light receiving element 46 senses the slit 40 in the type element 18, the controller stops counting the encoder clock and discriminates the kind of the type element 18 from the count. Various control tables such as printing pressure control, printing pitch control and type selection control are suitably varied in conformity to the discriminated kind of type wheel 18. The controller continues to rotate the type wheel 18 until it is supplied with a home position signal by the rotary encoder 50, whereby the type wheel 18 is located in its home position and the entire initializing stage is completed.

Figure 6:
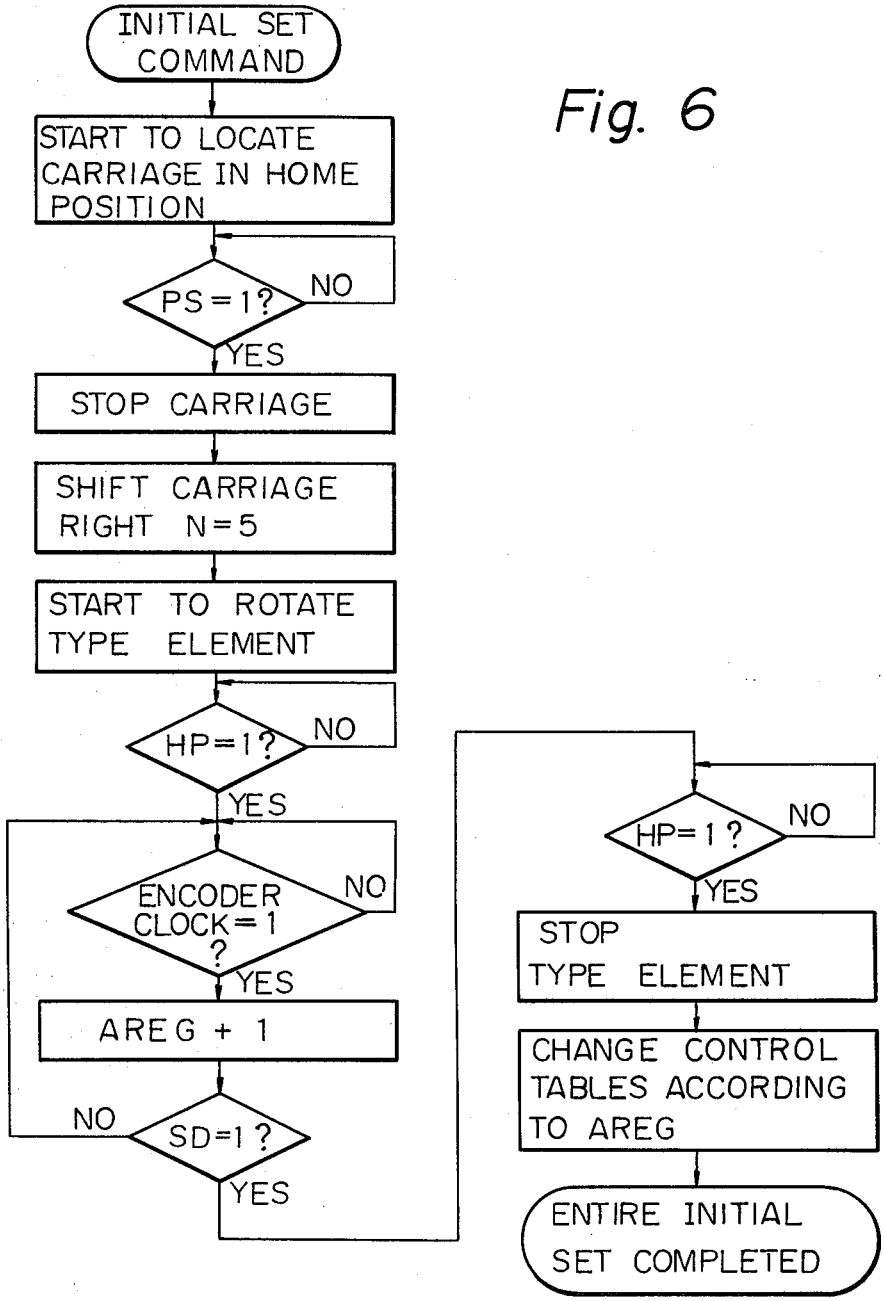
FIG. 6 is a flowchart representing an operation of the impact printer indicated in FIGS. 4 and 5.

Such successive steps of operation of the printer are indicated in a flowchart in FIG. 6. In the flowchart, indicated by PS is a carriage detection output of the photosensor 64, HP a type wheel home position output of the rotary encoder 50, and SD a slit detection output of the light receiving element 46. N=5 represents an example of a distance travelled by the carriage 14 which is dictated by a minimum space decomposing ability. Further, AReg indicates a content of a counter incorporated in the controller.

It will be apparent that the automatic discrimination described is applicable not only to the wheel-shaped type element but to those type elements in the form of a cylinder, a ball etc. In the latter case, the light emitting element 46 will be located inside the ball or the cylinder. The slit 40 may be replaced by a reflecting mark so that the photosensor 42, 46 detects the mark by reflection.

To summarize the above construction and arrangement, the replacable type element 18 is provided with the optical mark 40 for identification while the light emitting element 42 is mounted on the carriage 14 and the light receiving element 46 on the frame member 44 of the printer. The mark 40 is detected during rotation of the type element 18 to automatically distinguish the type element from the others. This permits a mark detection output to be picked up positively from the stationary frame side of the printer, in contrast to the prior art which has picked it up from the movable carriage side.

Figure 7:
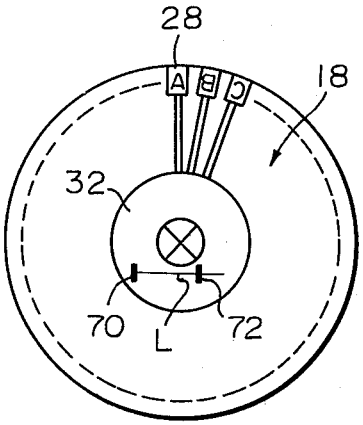
FIG. 7 is a front view of another type element applicable to the present invention.
Figure 9:
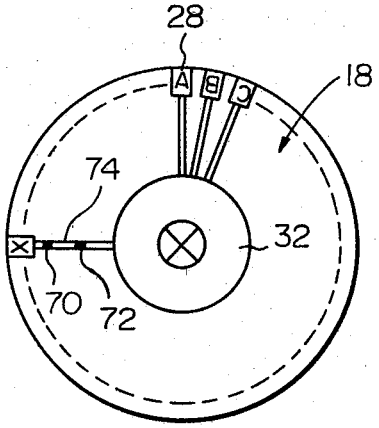
FIG. 9 is a front view of still another type element applicable to the present invention.
Figure 8:
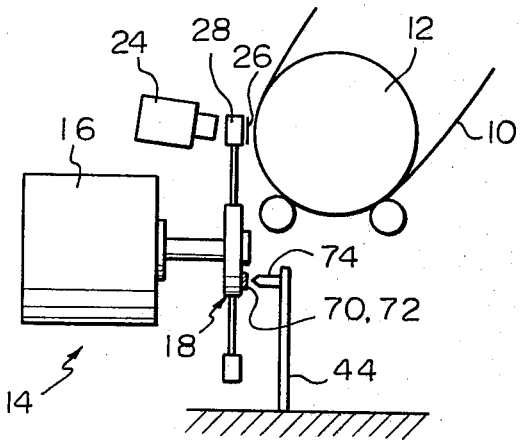
FIG. 8 is a side elevation of an impact printer according to another embodiment of the invention which incorporates the type element of FIG. 7 therein.

Referring to FIGS. 7–9, there is shown a second embodiment of the present invention. The type wheel 18, as shown in FIG. 7, carries a magnetic piece 70 in a reference position on a line L on the rotary hub 32 and a second magnetic piece 72 in a position on the line L spaced a suitable distance from the reference magnetic piece 70. A magnetic sensor 74 is mounted on the frame member 44 of the printer in a position corresponding to the magnetic pieces 70, 72, as shown in FIG. 8. The construction and arrangement is such that, in the course of the movement of the carriage 14, the magnetic pieces or marks 70, 72 are sensed sequentially by the magnetic sensor 74 along the line L.

In the printer shown in FIGS. 7–9, the distance between the magnetic pieces 70, 72 on the type wheel 18 represents the specific kind of the type wheel 18. When the type wheel 18 on the carriage 14 is held in a standstill in its home position, the line L will become parallel to the direction of movement of the carriage 14. Thus, as the carriage 14 is caused to restore the home position with the type wheel 18 held in the home position, the magnetic sensor 74 located ahead of the carriage home position successively senses the spaced magnetic pieces 70, 72 to automatically discriminate the kind of the type wheel 18 in terms of the spacing between the magnetic pieces 70, 72.

Such automatic discrimination is also achievable, if desired, by suitably arranging a plurality of magnetic coded pieces along the line L on the rotary hub 32 of a type wheel 18 such that the magnetic sensor on the frame member 44 sequentially reads the coded data during movement of the carriage 14. The reference magnetic piece 70 on the type element 18 may be omitted if the home position of the carriage 14 is utilized as a reference. In such a case, the automatic discrimination will occur on the basis of the interval from the instant the magnetic sensor 74 detects the magnetic piece 72 while the carriage 14 is being restored to the instant a home sensor such as a photointerrupter located in the carriage home position produces an output.

Alternatively, as viewed in FIG. 9, the line L on the rotary hub 32 of the type wheel 18 may be constituted by a finger or tongue 74 of the type wheel which is to extend parallel to the direction of movement of the carriage 14 when the type element is in the home position. In FIG. 9, the magnetic pieces or marks 70, 72 are positioned at suitably spaced locations on said particular tongue 74.

In any case, that is, with or without the reference magnetic piece 70, a practical means for automatically discriminating the type element 18 in terms of interval may comprise a rotary encoder mounted on the carriage drive motor (servo motor) as in the foregoing embodiment. For the case with the reference magnetic piece 70, the output pulses of the rotary encoder will be counted from the instant the reference piece 70 is detected to the instant the second piece 72 is detected. For the other case without the reference piece 70, the encoder output pulses will be counted from the instant the magnetic piece 72 is detected over to the instant the home position of the carriage 14 is detected.

Again, as for the home position of the type wheel 18 on the carriage 14, the reference position is preset in the rotary encoder which is mounted on the type selecting motor 16. The type wheel 18 is keyed or otherwise secured to the output shaft of the motor 16 in a predetermined relation, so that its home position is determined by an angular position of the motor 16.

It will be seen that such a combination of the mark or marks on the type element 18 which are spaced in parallel relation to the direction of movement of the carriage 14 in the home position of the type element 18 and the sensor 74 on the stationary member 44 is effective in promoting efficient and positive detection of the mark or marks at the stationary side of the printer.

Figure 10:
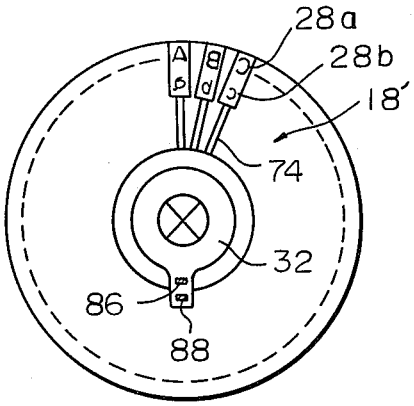
FIG. 10 is a front elevation of a further type element applicable to the present invention.
Figure 11:
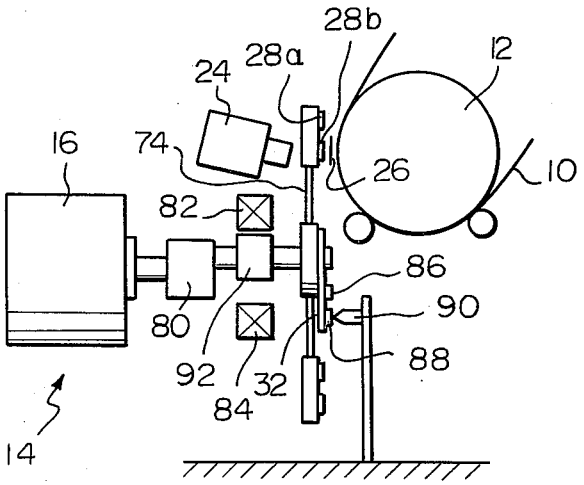
FIG. 11 is a side elevation of an impact printer according to still another embodiment of the invention which incorporates the type element of FIG. 10.

Referring to FIGS. 10–13, a third embodiment of the serial printer of the present invention will be described. In this embodiment, a double daisy type wheel 18' is used which carries two different types **28*a*, 28*b* at radially spaced locations at the leading end of each finger or tongue 74 thereof, as shown in FIG. 10. The type wheel 18' is mounted through a joint 80 to the output shaft of the motor 16 and driven selectively by upshifting and downshifting electromagnets 82, 84 to a position where radially outer or inner type 28 on a tongue 74** is selected.

In FIGS. 10–13, the mark bracket 32 mounted on the type wheel 18' is provided with a pair of radially spaced marks 86, 88 in the form of magnetic pieces. A magnetic sensor 90 is mounted on a stationary frame member of the printer. The arrangement is such that the sensor 90 senses the radially outermost mark 88 when the type wheel 18' is shifted upwardly in its home position, while detecting the radially innermost mark 86 upon a downward shift of the type wheel 18'. The reference numeral 92 in FIG. 11 denotes a core which cooperates with the electromagnets 82, 84.

In operation, suppose that the carriage 14 has restored its stand-by position and the type wheel 18' has been shifted upwardly, for example. The type wheel 18' is first returned to its home position allowing the sensor 90 to determine the presence/absence of the mark 88, whereupon the type wheel 18' is shifted downwardly causing the sensor 90 to determine the presence/absence of the mark 86. For instance, logical combinations of the marks 86, 88 may be employed as shown in Table below to discriminate the pitch of the type wheel 18' which is a fixed 1/10 inch pitch, a fixed 1/12 inch pitch or a proportional pitch. In Table, "0" indicates the absence of a mark and "1" the presence of the same.

TABLE

| WHEEL PITCH | MARK 86 | MARK 88 |
|---|---|---|
| fixed 1/10 pitch | 0 | 0 |
| fixed 1/12 pitch | 1 | 0 |
| proportional pitch | 0 | 1 |

Figure 12:
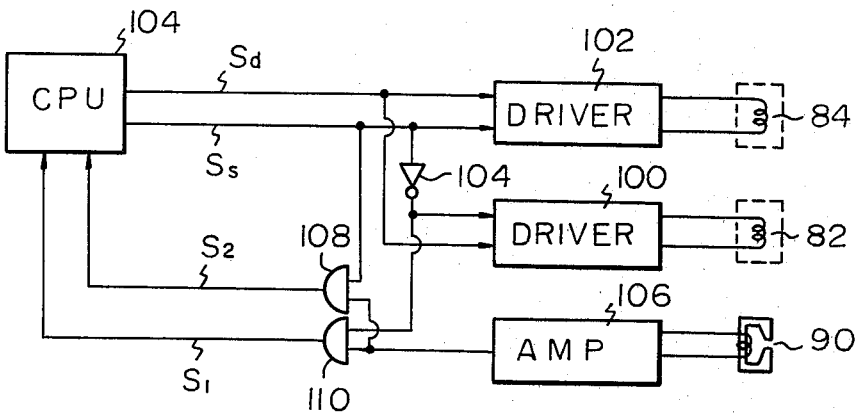
FIG. 12 is a block diagram showing an example of a mark detection circuit relevant with the embodiment of FIGS. 10 and 11.

An example of a mark detection circuit associated with the sensor 90 is illustrated in FIG. 12. A system control (CPU) 104 supplies a drive signal Sd to drivers 100, 102 which are adapted to drive the electromagnets 82, 84, respectively. The system control 104 also supplies an up/down shift select signal Ss directly to the driver 102 and, via an inverter 104, to the driver 100, so as to selectively energize the electromagnets 82, 84. The output of the sensor 90 is amplified by an amplifier 106 and coupled to an AND gate 108 which also receives the up/down shift select signal Ss, the output of the AND gate 108 being supplied to the system control 104. The amplified output of the amplifier 106 is also fed to a second AND gate 110 together with the output of the inverter 104, the AND gate 110 being also connected to the system control 104.

When the drive signal Sd appearing from the system control 104 is logical "1" while the up/down shift select signal Ss is logical "0", the driver 100 is actuated to energize the electromagnet 82 so that the type wheel 18' is upshifted. Then, the sensor 90 detects the mark 88 and the resultant signal $S_1$ is coupled from the AND gate 110 to the system control 104. Thereafter, the up/down shift select signal Ss is made logical "1" to actuate the driver 102 whereby the type wheel 18' is downshifted and the sensor 90 detects the mark 86, the detection signal $S_2$ being coupled from AND gate 108 to the system control 104. The system control 104 discriminates the kind of the type wheel 18' in accordance with a combination of the successively supplied detection signals $S_1$, $S_2$. Naturally, the mark 86 may be detected first by downshifting the type wheel 18' and then the mark 88 by upshifting the type wheel 18'. In any event, the mark 88 detection output or the mark 86 detection output is made effective in accordance with the drive signal Sd or the up/down shift select signal Ss, enabling the marks 88, 86 to be detected in a positive manner.

If desired, a plurality of magnetic sensors may be arranged in parallel relation and a pair of upper and lower marks may be arranged side by side on the mark bracket of a type wheel 18' in correspondence with each magnetic sensor. This increases the possible number of combinations in presence/absence of the marks and, thereby, the amount of data for discrimination. The mark bracket 32 is needless if the marks 86, 88 are arranged on a tongue 74 of a type wheel 18' which is to extend vertically in the home position of the type wheel 18'.

Figure 13:
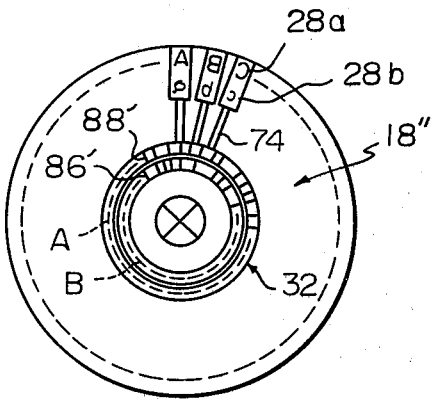
FIG. 13 is a front view of a type element also applicable to the present invention.

A modification to the type wheel 18' is shown in FIG. 13 which is designed to readily provide a significant amount of data for discrimination. The type wheel 18'' in FIG. 13 has an upper or radially outer annular code zone A on its rotary hub 32 which will correspond to the magnetic sensor 90 when the type wheel 18'' is upshifted. The type wheel 18' also has a lower or radially inner annular code zone B on the rotary hub 32 which will correspond to the magnetic sensor 90 when the type wheel 18'' is downshifted. Each of the annular code zones A, B is provided with a plurality of coded marks 86' or 88'. After the type wheel 18'' has been upshifted or downshifted, the type wheel 18'' is rotated to cause the sensor 90 to sequentially read the data stored in the upper code zone A or the lower code zone B. It will be needless to mention that the coded marks 86', 88' in the zones A, B may be replaced by marks which represent different angular distances from the home position of the type wheel.

Furthermore, if the decomposing ability of the sensor 90 is sufficiently high, a plurality of coded marks may be substituted for the marks 86, 88 so that they can be read by the sensor 90 while the type wheel is shifted.

It should be noted that for the embodiment of FIGS. 10–13 the optical detection of a mark or marks according to the first embodiment may be employed in place of the magnetic detection.

It will be seen that the construction and arrangement shown in FIGS. 10–13 is particularly advantageous in that the available amount of data for the discrimination of a type wheel can be readily increased and in that the discrimination can be performed simply yet positively without any special means.

Various modifications will become possible for those skilled in the art after receiving the teachings of the present disclosure without departing from the scope thereof.

What is claimed is:

1. Impact printing apparatus employing a set of interchangeable rotary type elements and identifying each rotary type element mounted thereon to optimumly match various printing conditions to the identified rotary type element, comprising:

a movable carriage which mounts each rotary type element comprising a rotary hub and a plurality of tongues carrying type members, a hammer for selectively impacting the type members and drive means for rotatably driving the rotary type element;

a stationary frame member which mounts a generally cylindrical paper support platen against which the type members are impacted;

mark means provided on each type element for identifying the type element;

sensor means mounted on the stationary frame member at a home position of the carriage for sensing the mark means as the carriage is being linearly moved to the home position; and control means for identifying the type element on the carriage in accordance with the sensed mark means;

the drive means being constructed to hold the type element in a predetermined angular position in which the marks are spaced from each other in a direction which is parallel to a direction of movement of the carriage while the marks are being sensed by the sensor means, the marks being sensed by means of linear movement of the type element past the sensor means;

whereby a print control program is selected in conformity to the identified type element while desired printing is carried out in accordance with the selected program.

2. Impact printing apparatus as claimed in claim 1, in which the mark means are provided on the rotary hub of each type element.

3. Impact printing apparatus as claimed in claim 2, in which said mark means comprises a slit which is formed through the rotary hub.

4. Impact printing apparatus as claimed in claim 3, in which said mark means further comprises a reference slit which is formed at a type element home position.

5. Impact printing apparatus as claimed in claim 1, in which said mark means comprises a plurality of coded slits which are formed along the circumference of the rotary hub, said coded slits being read by the sensor means.

6. Impact printing apparatus employing a set of interchangeable rotary type elements and identifying each rotary type element mounted thereon to optimumly match various printing conditions to the identified rotary type element, comprising:

a movable carriage which mounts each rotary type element comprising a rotary hub and a plurality of tongues carrying type members, a hammer for selectively impacting the type members and drive members for rotatably driving the rotary type element;

a stationary frame member which mounts a generally cylindrical paper support platen against which the type members are impacted;

mark means provided on each type element for identifying the type element;

sensor means for sensing the mark means; and control means for identifying the type element on the carriage in accordance with the sensed mark means;

whereby a print program is selected in conformity to the identified type element while desired printing is carried out in accordance with the selected program;

the mark means comprising a slit which is formed through the rotary hub;

said sensor means comprising a photosensor including a light emitting element and a light receiving element which are located on the opposite sides of the type element in correspondence with the slit, said light emitting element being mounted on the movable carriage and said light receiving element being mounted on the stationary frame member.

7. Impact printing apparatus employing a set of interchangeable rotary type elements and identifying each rotary type element mounted thereon to optimumly match various printing conditions to the identified rotary type element, comprising:

a movable carriage which mounts each rotary type element comprising a rotary hub and a plurality of tongues carrying type members, a hammer for selectively impacting the type members and drive means for rotatably driving the rotary type element;

a stationary frame member which mounts a generally cylindrical paper support platen against which the type members are impacted;

mark means provided on each type element for identifying the type element;

sensor means mounted on the stationary frame member at a home position of the carriage for sensing the mark means when the carriage is moved to the home position; and control means for identifying the type element on the carriage in accordance with the sensed mark means;

whereby a print control program is selected in conformity to the identified type element while desired printing is carried out in accordance with the selected program;

said control means being responsive to said sensed mark means to identify said mounted type element by computing an angular distance between the mark means and a type element home position.

8. Impact printing apparatus employing a set of interchangeable rotary type elements and identifying each rotary type element mounted thereon to optimumly match various printing conditions to the identified rotary type element, comprising:

a movable carriage which mounts each rotary type element comprising a rotary hub and a plurality of tongues carrying type members, a hammer for selectively impacting the type members and drive means for rotatably driving the rotary type element;

a stationary frame member which mounts a generally cylindrical paper support platen against which the type members are impacted;

mark means provided on each type element for identifying the type element;

sensor means for sensing the mark means; and control means for identifying the type element on the carriage in accordance with the sensed mark means;

whereby a print program is selected in conformity to the identified type element while desired printing is carried out in accordance with the selected program;

the mark means being provided on the rotary hub of each type element;

said mark means comprising first and second mark, the drive means being constructed to hold the type element in a predetermined angular position in which the first mark is spaced from the second mark in a direction which is parallel to a direction of movement of the carriage while the first and second marks are being sensed by the sensor means, the first and second marks being sensed by means of linear movement of the type element past the sensor means.

9. Impact printing apparatus as claimed in claim 8, in which said first and second marks comprise magnetic pieces, said sensor means comprising a magnetic sensor for sequentially sensing the magnetic pieces while the carriage is moved to a carriage home position.

10. Impact printing apparatus as claimed in claim 9, in which said control means is responsive to said sensed first and second magnetic pieces to identify said mounted type element by computing a distance between the first and second magnetic pieces.

11. Impact printing apparatus as claimed in claim 2, in which said mark means comprises a plurality of coded marks which are read by the sensor means.

12. Impact printing apparatus as claimed in claim 11, in which said coded marks comprise magnetic coded pieces, said sensor means comprising a magnetic sensor for reading the magnetic coded pieces.

13. Impact printing apparatus employing a set of interchangeable rotary type elements and identifying each rotary type element mounted thereon to optimumly match various printing conditions to the identified rotary type element, comprising:

a movable carriage which mounts each rotary type element comprising a rotary hub and a plurality of tongues carrying type members, a hammer for selectively impacting the type members and drive means for rotatably driving the rotary type element;

a stationary frame member which mounts a generally cylindrical paper support platen against which the type members are impacted;

mark means provided on each type element for identifying the type element;

sensor means for sensing the mark means; and control means for identifying the type element on the carriage in accordance with the sensed mark means;

whereby a print program is selected in conformity to the identified type element while desired printing is carried out in accordance with the selected program;

the mark means being provided on a tongue which is positioned in parallel to a direction of movement of the carriage when the type element is held at a type element home position.

14. Impact printing apparatus as claimed in claim 13, in which said mark means comprises first and second marks which are provided on the tongue, the first mark being spaced from the second mark in the direction of movement of the carriage.

15. Impact printing apparatus as claimed in claim 14, in which said first and second marks comprise magnetic pieces, said sensor means comprising a magnetic sensor for sequentially sensing the magnetic pieces while the carriage is being moved to a home position thereof.

16. Impact printing apparatus as claimed in claim 15, in which said control means is responsive to said sensed first and second magnetic pieces to identify said mounted type element by computing a distance between the first and second magnetic pieces.

17. Impact printing apparatus as claimed in claim 13, in which said mark means comprises a plurality of coded marks which are read by the sensor means.

18. Impact printing apparatus as claimed in claim 17, in which said coded marks comprise magnetic coded pieces, said sensor means comprising a magnetic sensor for reading the magnetic coded pieces.

19. Impact printing apparatus employing a set of interchangeable rotary type elements and identifying each rotary type element mounted thereon to optimumly match various printing conditions to the identified rotary type element, comprising:

a movable carriage which mounts each rotary type element comprising a rotary hub and a plurality of tongues carrying type members, a hammer for selectively impacting the type members and drive means for rotatably driving the rotary type element;

a stationary frame member which mounts a generally cylindrical paper support platen against which the type members are impacted;

mark means provided on each type element for identifying the type element;

sensor means for sensing the mark means; and control means for identifying the type element on the carriage in accordance with the sensed mark means;

whereby a print program is selected in conformity to the identified type element while desired printing is carried out in accordance with the selected program;

at least one tongue carrying inner and outer type members, said drive means being constructed to shift the type element between inner and outer positions such that the inner and outer type members are selectively impacted by the hammer, said sensor means being constructed to sense either of the presence and absence of an inner mark provided on the type element when the type element is shifted to the inner position, and to sense either of the presence and absence of an outer mark provided on the type element when the type element is shifted to the outer position.

20. Impact printing apparatus as claimed in claim 19, in which said type element further comprises a mark bracket on which the inner and outer marks are provided.

21. Impact printing apparatus as claimed in claim 19, in which said control means is constructed to identify said mounted type element in response to a specific combination of the presence and absence of the inner mark and the presence and absence of the outer mark.

22. Impact printing apparatus as claimed in claim 19, in which said inner and outer marks comprise magnetic pieces, said sensor means comprising a magnetic sensor for sensing the presence and absence of the inner and outer magnetic pieces.

23. Impact printing apparatus as claimed in claim 19, in which said mark means comprises a plurality of inner marks and a plurality of outer marks which are formed along the circumference of the rotary hub, said sensor means comprising a plurality of inner sensors for sensing either of the presence and absence of the inner marks and a plurality of outer sensors for sensing either of the presence and absence of the outer marks.

24. Impact printing apparatus as claimed in claim 23, in which said control means is constructed to identify said mounted type element in response to a specific combination of the presence and absence of the inner and outer marks.

25. Impact printing apparatus employing a set of interchangeable rotary type elements and identifying each rotary type element mounted thereon to optimumly match various printing conditions to the identified rotary type element, comprising:

a movable carriage which mounts each rotary type element comprising a rotary hub and a plurality of tongues carrying type members, a hammer for selectively impacting the type members and drive means for rotatably driving the rotary type element;

a stationary frame member which mounts a generally cylindrical paper support platen against which the type members are impacted;

mark means provided on each type element for identifying the type element;

sensor means mounted on the stationary frame member at a home position of the carriage for sensing the mark means when the carriage is moved to the home position; and control means for identifying the type element on the carriage in accordance with the sensed mark means;

whereby a print control program is selected in conformity to the identified type element while desired printing is carried out in accordance with the selected program;

the mark means being provided on the rotary hub of each type element;

at least one tongue carrying inner and outer type members, said drive means being constructed to shift the type element between inner and outer positions such that the inner and outer type members are selectively impacted by the hammer, said mark means comprising a plurality of inner coded marks and a plurality of outer coded marks, said inner and outer coded marks being formed along the circumference of the rotary hub, said sensor means being constructed to read the inner coded marks when the type element is shifted to the inner position and to read the outer coded mark when the type element is shifted to the outer position.

26. Impact printing apparatus as claimed in claim 25, in which said control means is constructed to identify said mounted type element in response to a specific combination of the read inner coded marks and the read outer coded marks.

* * * * *